US006073861A

United States Patent [19]

Wright et al.

[11] Patent Number: 6,073,861

[45] Date of Patent: Jun. 13, 2000

[54] PRESSURIZED FLUID CLEANING SYSTEM

[75] Inventors: Barry M. Wright, Groveland; Blake Nicodemus, Spencerport, both of N.Y.

[73] Assignee: Heliojet Cleaning Technologies, Inc., LeRoy, N.Y.

[21] Appl. No.: 09/317,521

[22] Filed: May 24, 1999

[51] Int. Cl.[7] ..... B05B 15/02; F23D 11/34

[52] U.S. Cl. ..... 239/114

[58] Field of Search ..... 239/104, 106, 239/114, 123, 71, 72, 74, 124, 126; 222/148; 417/20, 31, 38, 43

[56] References Cited

U.S. PATENT DOCUMENTS

| | | | |
|---|---|---|---|
| 2,899,929 | 8/1959 | Monroe | 239/123 X |
| 4,569,635 | 2/1986 | Nicodemus | 417/196 |
| 5,427,624 | 6/1995 | Laventure | 239/114 X |
| 5,503,333 | 4/1996 | Laventure | 239/114 |
| 5,529,460 | 6/1996 | Eihusen et al. | 239/124 X |

*Primary Examiner*—Kevin Weldon
*Assistant Examiner*—Sean P. O'Hanlon
*Attorney, Agent, or Firm*—Robert J. Bird

[57] ABSTRACT

A pressurized fluid cleaning system includes a fluid source, a discharge line leading to a spray discharge element, and a motor driven cleaner such as a cleaning brush to clean the spray discharge element. A sensor in the discharge line responds to fluid back pressure above a pre-established level (or to flow rate below a pre-established level) to actuate a cleaner "on" switch. Additionally or alternatively, a fluid sensor in an overflow line from the fluid source responds to fluid in the overflow line to actuate the cleaner "on" switch. The sensors are also connected to a warning device and to a delayed response system "off" switch to shut down the entire system for human intervention.

23 Claims, 2 Drawing Sheets

PRESSURIZED FLUID CLEANING SYSTEM

BACKGROUND OF THE INVENTION

This invention relates to pressurized fluid cleaning systems, and more specifically to detection systems to provide corrective response to impaired cleaning action caused by plugged nozzle orifices or faulty equipment operation.

Industrial processes commonly include systems for cleaning the process equipment in place by means of fluid under pressure. Spray discharge elements (such as shower headers, spray nozzles, tank washers, and spray balls) in these clean-in-place systems can become progressively occluded by deposits or debris from use over a period of time. Occluded orifices cause increased back pressure, reduced fluid flow, and reduced cleaning effectiveness of the flow element.

SUMMARY OF THE INVENTION

A pressurized fluid cleaning system according to this invention includes a fluid source and a discharge line leading to a spray discharge element. The improvement includes a motor driven cleaner such as a cleaning brush within the discharge element. A sensor in the discharge line responds to fluid back pressure above a pre-established level (or to flow rate below a pre-established level) to actuate a cleaner "on" switch. Additionally or alternatively, a fluid sensor in an overflow line from the fluid source responds to fluid in the overflow line to actuate the cleaner "on" switch.

DETAILED DESCRIPTION

Figure 1:
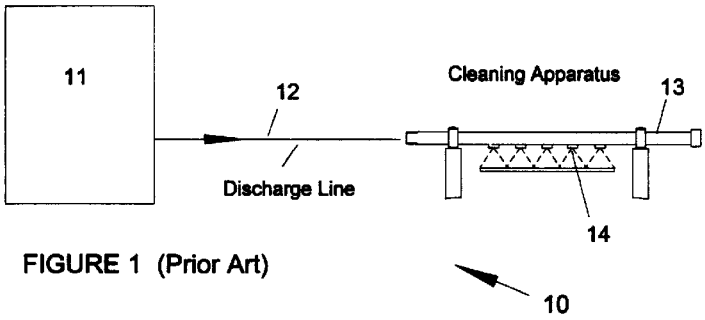
FIGURE 1 (Prior Art)
FIG. 1 is a schematic diagram of a conventional pressurized fluid cleaning system of the prior art.

Referring to FIG. 1, a conventional pressurized fluid cleaning system 10 includes a source 11 of fluid under pressure, a discharge line 12, and a spray discharge element 13 (e.g. a shower header, spray ball, or the like) connected to the discharge line 12. The spray discharge element 13 includes a number of spray nozzles or orifices 14. In this prior art system, as the orifices 14 become progressively restricted by scale or debris, fluid flow is reduced and the spray-cleaning function of the spray discharge element 13 is impaired. Reduced fluid flow and impaired cleaning eventually become noticeable, and corrective action is taken. The cleaning system 10 and the process equipment associated with it are shut down, the spray discharge element 13 is cleaned of obstructing scale or debris, and the process equipment and cleaning system are restored to operation. The associated process equipment to be kept clean by the cleaning system 10 is not shown.

Figure 2:
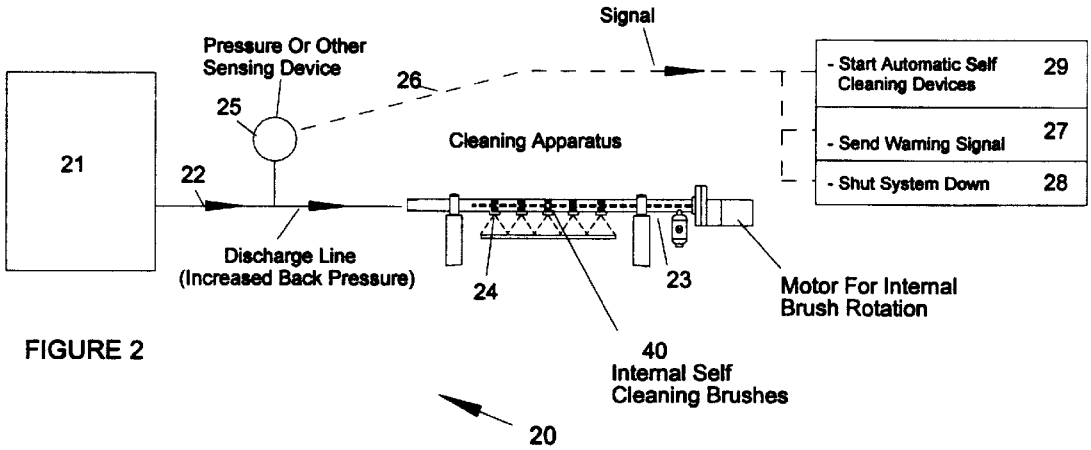
FIG. 2 is a schematic diagram of a pressurized fluid cleaning system according to one embodiment of this invention.

FIG. 2 represents a pressurized fluid cleaning system 20 according to this invention. This system, like that of FIG. 1, includes a source 21 of fluid under pressure, a discharge line 22, and a spray discharge element 23 (e.g. shower header or spray ball) connected to the discharge line 22. The spray discharge element 23 includes a number of spray nozzles or orifices 24. The cleaning system 20 further includes a sensor 25, such as a pressure sensor or fluid flow sensor, in the discharge line 22. For the sake of this discussion, consider the sensor 25 to be a pressure sensor.

The pressure sensor 25 is operatively connected to (i) an audio or visual warning device 27; (ii) a cleaning system shut-off or "off" switch 28; and (iii) a cleaning brush start-up or "on" switch 29. The output signal from the pressure sensor 25 to the warning device 27, switch 28, and switch 29 is represented by a dashed line 26. As the orifices 24 become restricted and fluid flow is reduced, back pressure in the discharge line 22 increases. When back pressure in the discharge line 22 reaches a pre-established level, the pressure sensor 25 signals the operation of one, two, or all three elements 27, 28, 29: the warning device 27, the cleaning system "off" switch 28, and cleaner "on" switch 29 to actuate a motor driven cleaner, such as a cleaning brush 40, to clean the orifices 24 of the spray discharge element 23. When the spray discharge element 23 and orifices 24 are cleaned, the process equipment and cleaning systems are restored to operation, manually or automatically. In an automatic mode, when the orifices 24 have been cleaned, the pressure sensor 25 no longer sends out signals to elements 27, 28, 29, and the equipment resumes normal operation.

In the system of FIG. 2, the fluid source 21 may be a conventional pump or fluid supply, or it may be a steam injection pumping system.

Figure 3:
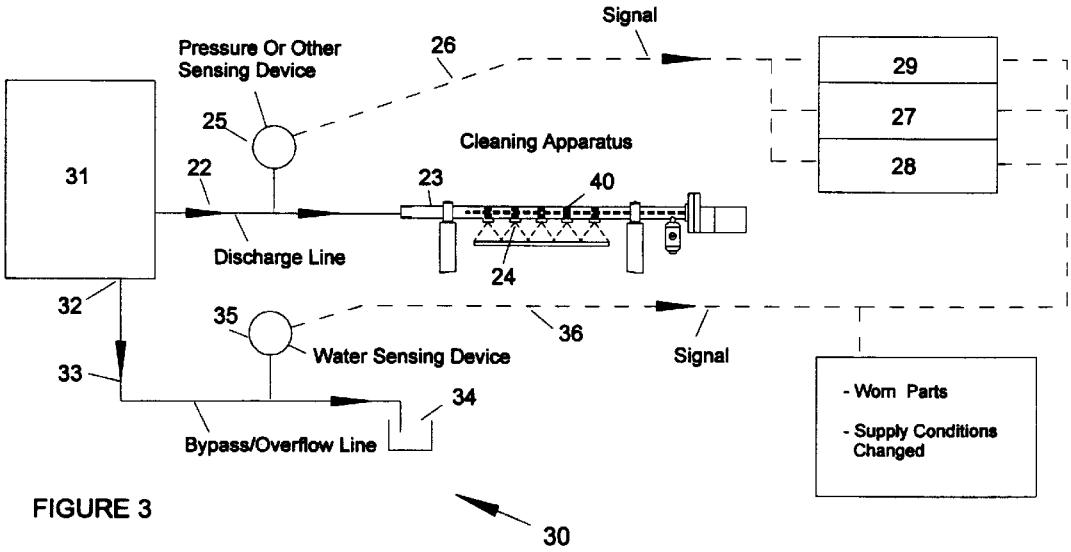
FIG. 3 is a schematic diagram of a pressurized fluid cleaning system according to another embodiment of this invention.
Figure 4:
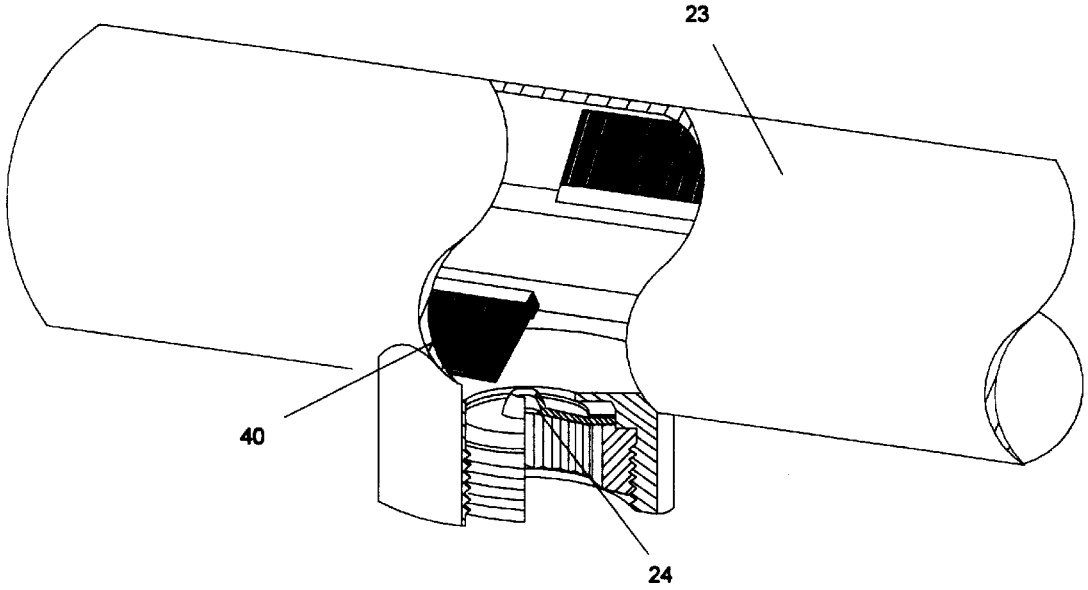
FIG. 4 is an enlarged detail view of a nozzle and cleaning brush.

FIG. 3 represents a pressurized fluid cleaning system 30 according to another embodiment of this invention. This system includes a source 31 of fluid under pressure, a discharge line 22, and a spray discharge element 23 with spray nozzles or orifices 24. A pressure sensor 25 in the discharge line 22 is connected to a warning device 27, cleaning system "off" switch 28, and cleaning brush "on" switch 29. As the orifices 24 become restricted and back pressure in the discharge line 22 reaches a pre-established level, the pressure sensor 25 signals the operation of one or more of the elements 27, 28, 29. This much of the system of FIG. 3 is similar to that of FIG. 2, except that in FIG. 3 the fluid source 31 is a steam injection pump of the type described in U.S. Pat. No. 4,569,635 to Carl D. Nicodemus. The disclosure of that patent is incorporated herein by reference.

The steam injection pump 31 includes an overflow port 32. An overflow line 33 extends from the overflow port 32 to a drain 34. The overflow line 33 includes a fluid detector 35 to detect overflow. The fluid detector 35 (like the pressure sensor 25) is operatively connected to the warning device 27, cleaning system "off" switch 28, and cleaning brush "on" switch 29. The output signal from the fluid detector 35 to the warning device 27, switch 28, and switch 29 is represented by a dashed line 36. If fluid flow from the pump 31 is resisted because of restricted orifices in the cleaning system, fluid is forced to escape through the overflow port 32. The fluid detector 35 detects the overflow and (like the pressure sensor 25) actuates one or more of elements 27, 28, 29. The overflow signal will also indicate other overflow-causing conditions such as worn and improperly functioning internal parts, or changes in supply fluid or steam conditions.

The system 20 of FIG. 2 is responsive to pressure (or flow) in the discharge line 22. The system 30 of FIG. 3 is responsive to pressure (or flow) in the discharge line 22, and/or to fluid in an overflow line 33. The two response systems in FIG. 3 may or may not be independent of each other.

The sensor 25 in systems 20 and 30 may be a pressure sensor, fluid flow sensor, or the like as stated earlier. If it is a pressure sensor, it responds to fluid back pressure above a pre-established level to signal the operation of the warning device 27 and the brush "on" switch 29, as described above. If it is a fluid flow sensor, it responds to fluid flow below a pre-established level to signal the operation of the warning device 27 and the brush "on" switch 29.

The sensors 25 are described above as being operatively connected to a warning device 27 and to switches 28 and 29. More generally, the sensors 25 may be connected selectively to one or any combination of the elements 27, 28, 29.

As stated earlier, the systems of FIGS. 2 and 3 each include a cleaning system "off" switch 28 connected to the sensor 25 in the discharge line 22 (the "off" switch 28 in FIG. 3 can be further connected to a fluid detector 35 in the overflow line 33). Signals that go from the sensors 25 and 35 to the warning device 27 and to the "on" switch 29, go also to the system "off" switch 28. It may or may not be desirable that the system shut down immediately in response to signals from the sensors 25 or 35 because, of course, fluid is needed to accomplish the primary cleaning function of the apparatus. After a certain elapsed time, however, if the spray elements 23, 24 are not cleaned, and signals still go out from the sensors, then the "off" switch 28 will shut the entire system down for human intervention. In short, the response of the "off" switch 28 to a sensor signal may be delayed.

In the above examples, the cleaner 40 is a brush, but it might be a jet spray device or other known form of mechanical cleaning device.

The fluid detector 35 in FIG. 3 may be a "wetness" sensor, a fluid level sensor, a fluid flow sensor, a pressure detector, or the like.

It is contemplated that the systems of this invention will be used primarily with water as the working fluid, but other fluids may be used and may even be preferable for certain applications.

The foregoing description of preferred embodiments of this invention is intended as illustrative. The concept and scope of the invention are limited only by the following claims and equivalents thereof.

What is claimed is:

1. A pressurized fluid cleaning system, including a source of fluid under pressure, a discharge line extending from said fluid source, a spray discharge element operatively connected to said discharge line, and the improvement comprising:

a motor driven cleaner to clean said spray discharge element; and a sensor communicating with said discharge line and operatively connected to a cleaner "on" switch, said sensor responsive to a hydraulic condition in said discharge line to actuate said cleaner "on" switch.

2. A pressurized fluid cleaning system as defined in claim 1, in which said cleaner is a cleaning brush.

3. A pressurized fluid cleaning system as defined in claim 1, in which said sensor is further operatively connected to a warning device.

4. A pressurized fluid cleaning system as defined in claim 1, in which said sensor is further operatively connected to a cleaning system "off" switch.

5. A pressurized fluid cleaning system as defined in claim 4, in which said cleaning system "off" switch is operable in delayed response to said sensor.

6. A pressurized fluid cleaning system as defined in claim 1, in which said sensor is a pressure sensor responsive to back pressure in said discharge line above a pre-established level to actuate said cleaner "on" switch.

7. A pressurized fluid cleaning system as defined in claim 1, in which said sensor is a fluid flow sensor responsive to fluid flow in said discharge line below a pre-established level to actuate said cleaner "on" switch.

8. A pressurized fluid cleaning system, including a source of fluid under pressure, a discharge line and an overflow line extending from said fluid source, a spray discharge element operatively connected to said discharge line, and the improvement comprising:

a motor driven cleaner to clean said spray discharge element; and a fluid detector communicating with said overflow line and operatively connected to a cleaner "on" switch, said fluid detector responsive to fluid in said overflow line to actuate said cleaner "on" switch.

9. A pressurized fluid cleaning system as defined in claim 8, in which said cleaner is a cleaning brush.

10. A pressurized fluid cleaning system as defined in claim 8, in which said fluid detector is further operatively connected to a warning device.

11. A pressurized fluid cleaning system as defined in claim 8, in which said fluid detector is further operatively connected to a cleaning system "off" switch.

12. A pressurized fluid cleaning system as defined in claim 11, in which said cleaning system " off" switch is operable in delayed response to said fluid detector.

13. A pressurized fluid cleaning system as defined in claim 8, in which said fluid source is a steam injection pump.

14. A pressurized fluid cleaning system, including a source of fluid under pressure, a discharge line and an overflow line extending from said fluid source, a spray discharge element operatively connected to said discharge line, and the improvement comprising:

a motor driven cleaner to clean said spray discharge element;

a sensor communicating with said discharge line and operatively connected to a cleaner "on" switch, said sensor responsive to a hydraulic condition in said discharge line to actuate said cleaner "on" switch; and a fluid detector communicating with said overflow line and operatively connected to said cleaner "on" switch, said fluid detector responsive to fluid in said overflow line to actuate said cleaner "on" switch.

15. A pressurized fluid cleaning system as defined in claim 14, in which said cleaner is a cleaning brush.

16. A pressurized fluid cleaning system as defined in claim 14, in which said sensor is further operatively connected to a warning device.

17. A pressurized fluid cleaning system as defined in claim 14, in which said sensor is further operatively connected to a cleaning system "off" switch.

18. A pressurized fluid cleaning system as defined in claim 17, in which said cleaning system "off" switch is operable in delayed response to said sensor.

19. A pressurized fluid cleaning system as defined in claim 14, in which said sensor is a pressure sensor responsive to back pressure in said discharge line above a pre-established level to actuate said cleaner "on" switch.

20. A pressurized fluid cleaning system as defined in claim 19, in which said pressure sensor is further operatively connected to a warning device.

21. A pressurized fluid cleaning system as defined in claim 14, in which said sensor is a fluid flow sensor responsive to fluid flow in said discharge line below a pre-established level to actuate said cleaner "on" switch.

22. A pressurized fluid cleaning system as defined in claim 21, in which said fluid flow sensor is further operatively connected to a warning device.

23. A pressurized fluid cleaning system as defined in claim 14, in which said fluid source is a steam injection pump.

* * * * *